United States Patent [19]

Hannie et al.

[11] 4,231,861

[45] Nov. 4, 1980

[54] GRAIN CLEANING APPARATUS

[75] Inventors: Steven G. Hannie, Bloomington; Terry D. Tucker, East Peoria, both of Ill.

[73] Assignee: Parsons Manufacturing, Incorporated, Roanoke, Ill.

[21] Appl. No.: 24,057

[22] Filed: Mar. 26, 1979

[51] Int. Cl.[3] ..... B07B 1/46

[52] U.S. Cl. ..... 209/240; 209/246; 209/274

[58] Field of Search ..... 209/240, 243, 246, 279, 209/352, 355, 281, 497, 499, 356, 254, 274, 253, 363; 210/433 R, 434; 222/481

[56] References Cited

U.S. PATENT DOCUMENTS

| | | | |
|---|---|---|---|
| 176,070 | 4/1876 | Satterfield | 209/246 |
| 187,801 | 2/1877 | Badger | 209/356 |
| 261,193 | 7/1882 | Winchester | 209/356 |
| 580,289 | 4/1897 | Morse | 209/370 |
| 841,959 | 1/1907 | Geutrup | 209/356 |
| 977,677 | 12/1910 | Pidgeon | 209/356 |
| 1,229,542 | 6/1917 | Stewart | 209/281 X |
| 1,229,542 | 6/1917 | Stewart | 209/257 |
| 1,945,242 | 1/1934 | Walker | 209/356 |
| 2,014,291 | 9/1935 | Reed | 209/499 X |
| 2,626,053 | 6/1953 | McEluaine | 209/240 |
| 3,237,072 | 2/1966 | Nelson | 209/172.5 X |
| 3,247,961 | 4/1966 | Chase | 209/172.5 X |
| 3,501,006 | 3/1970 | Adams | 210/433 R X |
| 3,771,624 | 11/1973 | Forgeson | 210/434 |
| 4,071,440 | 1/1978 | Jedo | 209/497 |

OTHER PUBLICATIONS

Parsons Mfr., Inc. Grain Handling Equipment Brochure.

Hunter Mfg., Inc. Panda Scavenger Brochure.

Clay Equipment Corp., Modern Mat'ls. Handling Equipment.

*Primary Examiner*—Robert Halper

*Attorney, Agent, or Firm*—Wegner, Stellman, McCord, Wiles & Wood

[57] ABSTRACT

A grain cleaning apparatus having an upstanding housing with a grain inlet, at least one layer of screens disposed below the inlet and a foreign material receiving chamber disposed below the screen, with separate outlets for foreign material and cleaned grain and integral means for bypassing a selected, infinitely variable, between limits, proportion of incoming grain flow around the screens to the grain outlet.

7 Claims, 6 Drawing Figures

FIG. 1
PRIOR ART
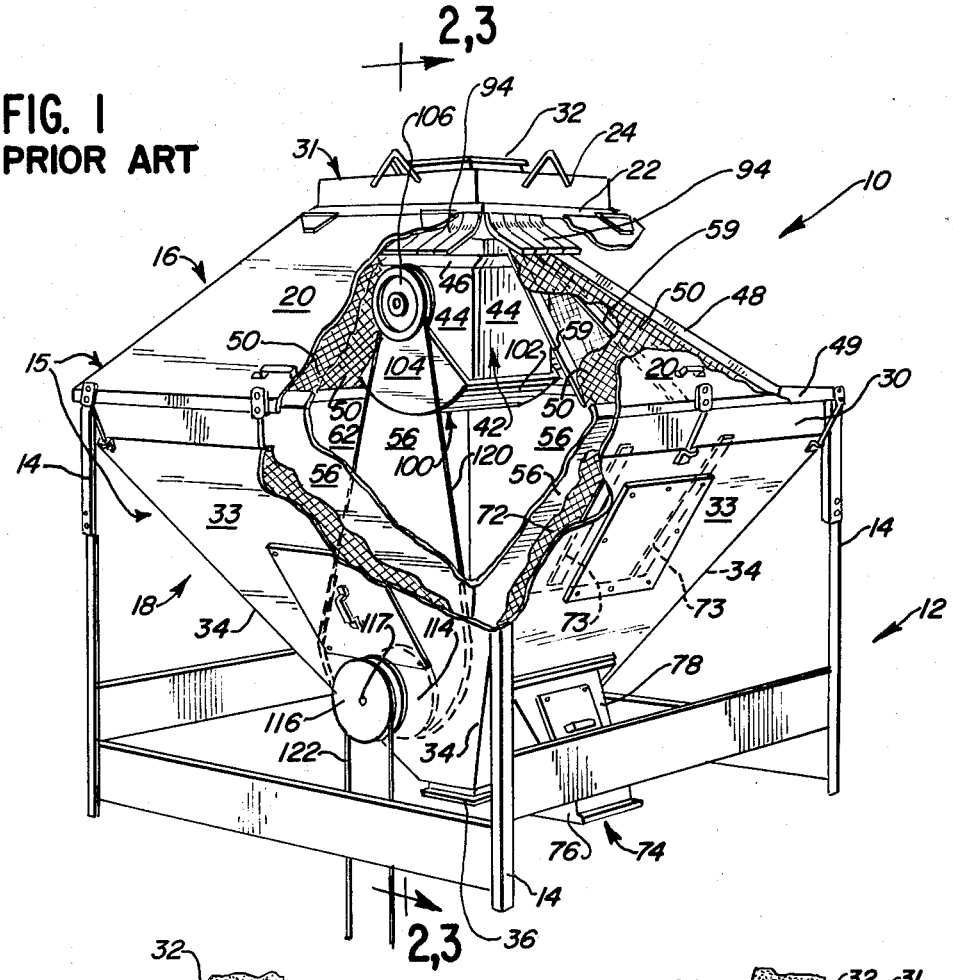
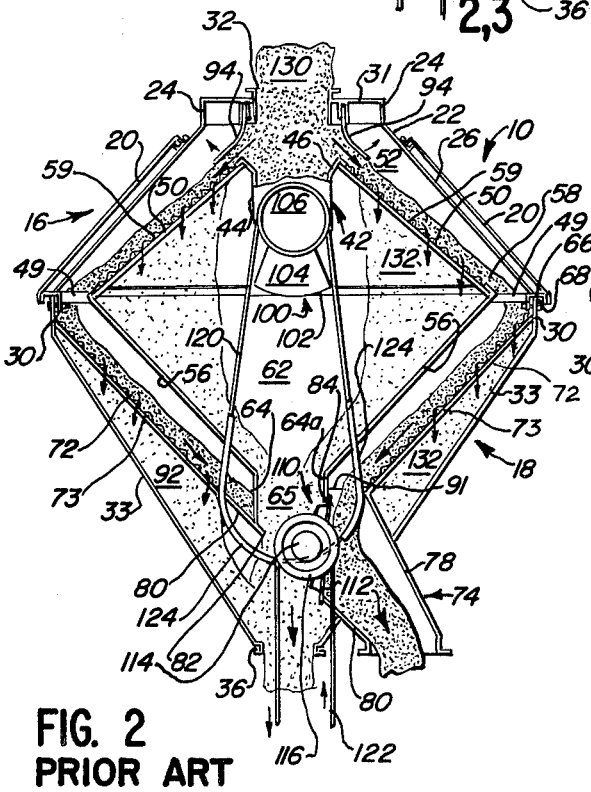
FIG. 2
PRIOR ART
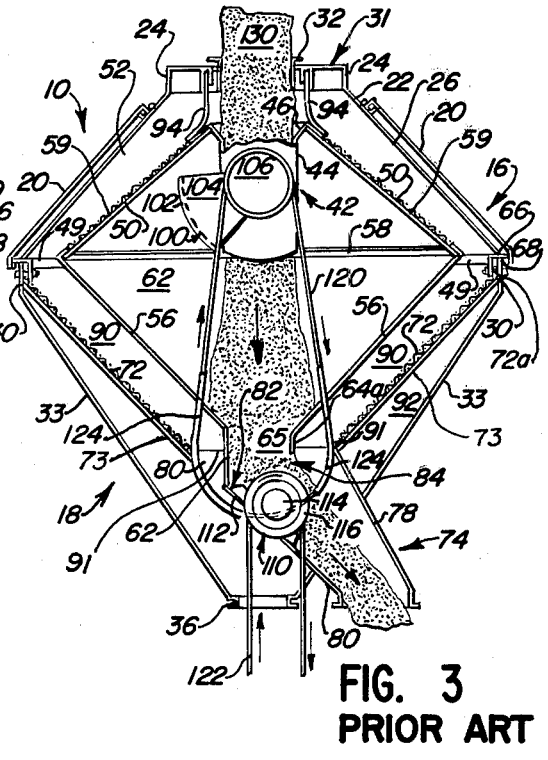
FIG. 3
PRIOR ART FIG. 4
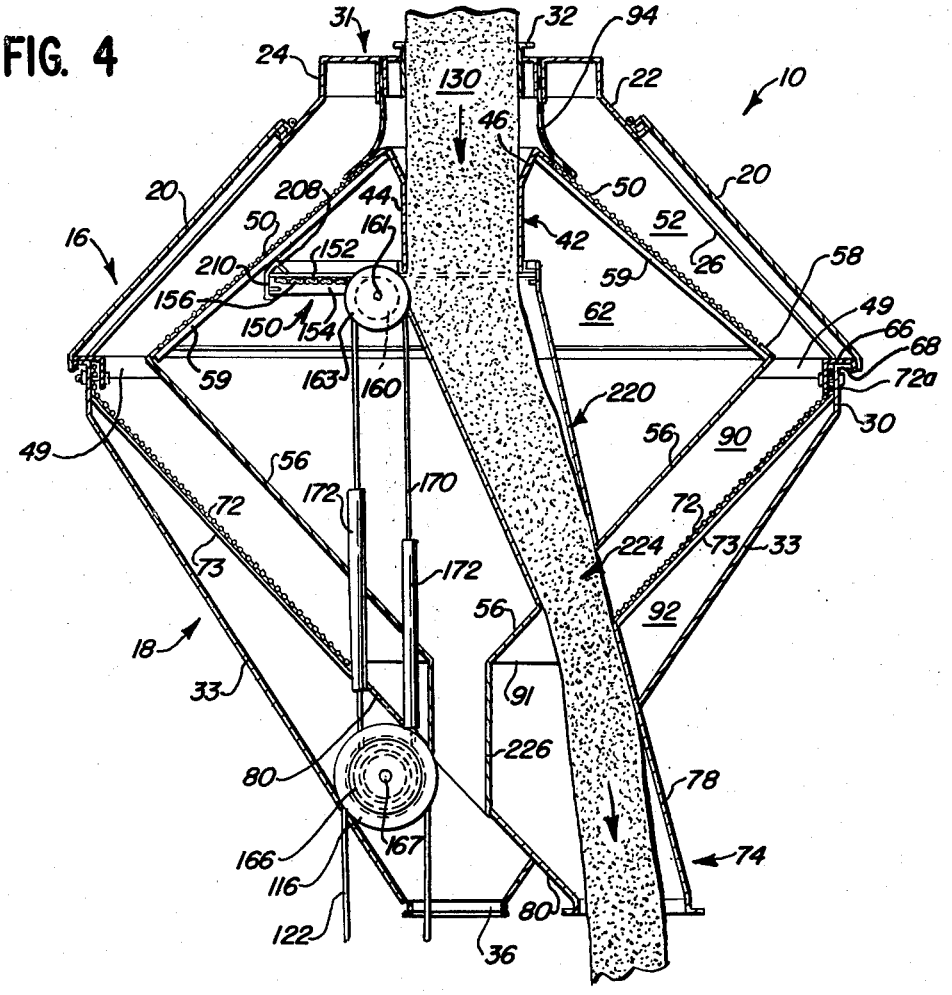
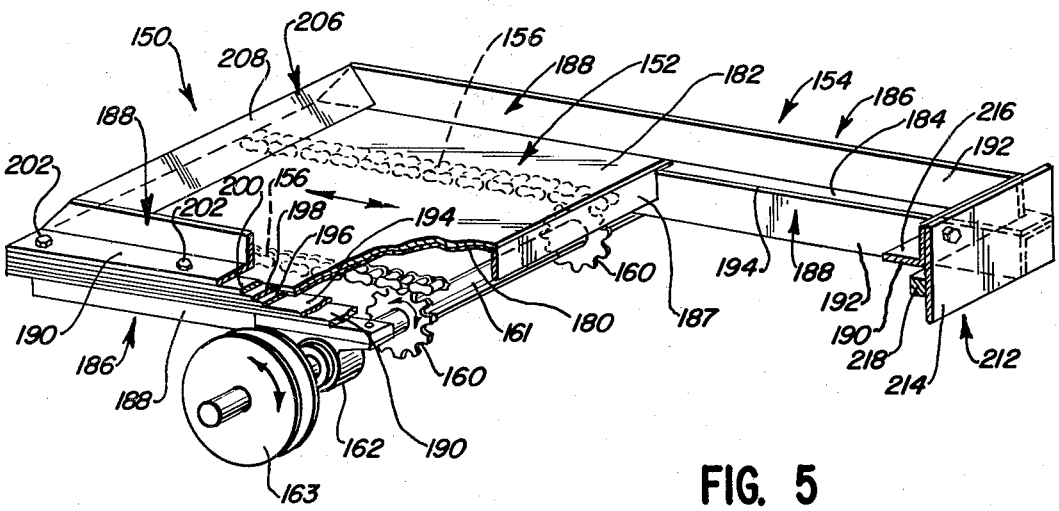
FIG. 5

GRAIN CLEANING APPARATUS

BACKGROUND OF THE INVENTION

1. Field of the Invention

This invention relates to a grain cleaning apparatus and, more specifically, this invention relates to a grain cleaning apparatus having an integral proportional bypass for diverting a portion of incoming grain flow from a screening area directly to a grain outlet.

2. General Description of the Prior Art

In grain handling operations, it is often necessary to reduce the amount of relatively small foreign material, such as dust, seeds, chaff, etc., mixed with grain before storage or shipment thereof. For example, removal of foreign material from grain can increase the efficiency of grain dryers because moisture is typically preferentially absorbed by foreign material. Further, grain cleaning is desirable before storage because small foreign material tends to accumulate near the center of stored grain, thereby obstructing air flow from aeration systems which protect the grain from heating and deterioration.

The Federal Inspection Grain Service Division of the U.S. Department of Agriculture has promulgated regulations requiring that certain grades of corn, soybeans, wheat and other grains may contain, when shipped, no more than specific maximum levels of foreign material. Any shipment of grain containing foreign material in excess of its market grade tolerance is "docked" according to a published scale and results in a net loss of income to the shipper.

It is not desirable to reduce the level of foreign material in shipped grain below the maximum level allowed by federal regulations, for economic reasons. Therefore, it is desirable to control the percentage of foreign material removed from grain before shipment.

One form of grain cleaner which has achieved widespread acceptance utilizes gravity flow of grain over a series of screens within an upstanding housing. Grain flows through an inlet at the housing's upper end and is directed outwardly and downwardly over a first layer of screens. Relatively small particles of foreign material fall through the screens into a first foreign material chamber communicating with a foreign material outlet at the housing's lower end.

Grain reaching the outer periphery of the first level of screens reverses its direction of flow and is directed downwardly and inwardly over a second layer of screens overlying a second foreign material receiving chamber, also communicating with the foreign material outlet. Relatively clean grain is received at the bottom of the second level of screens and is directed to a clean grain outlet chute which communicates with a storage facility, vehicle or other grain receiving means.

Such a grain cleaner is typically an integral part of a continuous grain handling system, and may be disposed between a dry elevator leg and a grain storage tank, or between a wet elevator leg and a grain dryer, for example. If relatively clean grain, not requiring cleaning, is to be transferred through a system having a grain cleaner, it may be desirable to bypass the cleaner's screens by means of external lines or integral bypass means.

One such well-known integral bypass system used with grain cleaners of the type described above comprises a grain-receiving valve box disposed below the grain inlet and generally at the upper screen level and having a selectively open or closed gate at its lower end.

When the gate is closed, grain flowing into the box fills and overflows the box to the upper screen layer. When the gate is open, all grain entering the grain inlet is directed downwardly through the box and through the first foreign material receiving chamber and to the grain outlet through a second gate disposed at the bottom of the first foreign material receiving chamber. When the valve box gate is closed, the lower gate is positioned to place the foreign material outlet in communication with the foreign material receiving chamber to prevent contamination of clean grain with foreign material and to allow removal of foreign material through the foreign material outlet. Due to the relationship between the positions of the upper and lower gates, it is impossible to proportion the flow of incoming grain between the screens and the foreign material chamber; only "on-off" bypass operation is possible.

Control of the foreign material content of discharged grain is relatively difficult with a grain cleaner having the integral bypass means described above due to the lack of a proportional cleaning capability. Lack of control of foreign material content results in diseconomies or in undesirable excessive foreign material levels in shipped grain.

SUMMARY OF THE INVENTION

The present invention is directed to overcoming one or more of the problems described above.

According to the present invention, a grain cleaning apparatus is provided with means for effecting an infinitely variable splitting, between limits, of grain flow between screening means and a bypass conduit communicating directly with a clean grain outlet.

More specifically, a single selectively positionable gate is disposed in a valve box directly underlying a grain inlet and communicating with an upper screen layer such that selective positioning of the gate allows a selected proportion of incoming grain to bypass the screens and to be directed through a chute communicating with the gate and with a clean grain outlet. The chute extends through the foreign material chamber but does not communicate therewith so that grain flowing through the chute is not exposed to foreign material.

The gate is infinitely variably positionable between fully open and fully closed positions and its position is, in practice, determined by the desired foreign material content of discharged grain and the foreign material content of incoming grain.

BRIEF DESCRIPTION OF THE DRAWINGS

FIG. 1 is a fragmentary perspective of a prior grain cleaner having integral bypass means;

FIG. 2 is a vertical section of the grain cleaner of FIG. 1, taken generally along line 2—2 of FIG. 1, with the bypass means shown in a closed position;

FIG. 3 is a vertical section of the grain cleaner of FIGS. 1 and 2, taken generally along line 3—3 of FIG. 1, with the bypass means shown in an open position;

FIG. 4 is a vertical section of a grain cleaner having proportional bypass means according to the present invention, with the bypass means shown in a fully open position;

FIG. 5 is a fragmentary perspective of the variably positionable bypass gate of the grain cleaner of FIG. 4.

DETAILED DESCRIPTION OF THE PREFERRED EMBODIMENT

Figure 6:
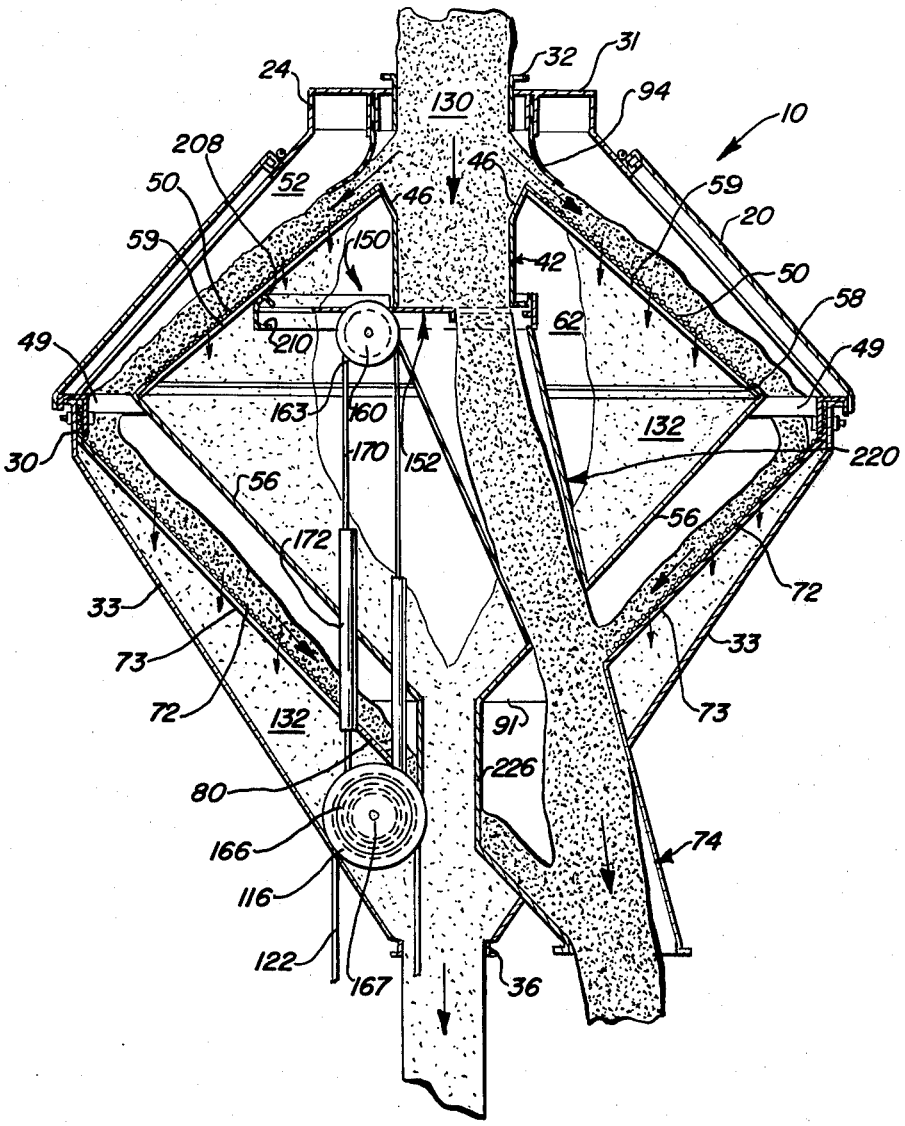
FIG. 6 is a vertical section of the grain cleaner of FIG. 4 with the proportional bypass means shown in a partially closed position.

Referring to FIG. 1, a grain cleaner, generally designated 10 and exemplary of the prior art, is illustrated. The grain cleaner 10 is supported on a stand 12 comprising four upstanding legs 14, and includes a housing 15 comprising two generally frustum-shaped upper and lower portions 16 and 18, respectively.

The upper housing portion 16 is defined by four truncated triangular walls 20 pivotally secured to a supporting frame 22 including four mutually perpendicular upstanding walls 24 and four support walls 22 and arms 26 extending downwardly and outwardly from the walls 24. The arms 26 terminate at their lower ends at four mutually perpendicular upstanding walls 30. A horizontal cover plate 31 extends inwardly from the walls 24. A rectangular grain inlet 32 extends vertically through the cover plate 31.

The lower housing portion 18 comprises four truncated triangular walls 33, integral with extending downwardly and inwardly from the walls 30 and joined at their adjacent edges 34. The lower housing portion 18 terminates at its lower end in a generally rectangular outlet 36.

Disposed directly below the grain inlet 32 is an upstanding valve box 42 comprising four mutually perpendicular walls 44, each wall 42 having an outwardly flared upper portion 46. A support leg 48 is secured to and extends outwardly and downwardly from each upper corner of the box 42 and terminates and is secured to an outwardly extending support arm 49 which in turn is secured to the housing 15 at respective corners of the walls 30. Extending between and removably secured to adjacent pairs of legs 48 are truncated triangular screens 50, terminating slightly above the upper level of the arms 49. The screens 50 and the walls 20 define an upper grain cleaning chamber 52.

Four truncated triangular walls 56 are secured to and extend downwardly and inwardly from the arms 49, each having an inwardly and upwardly directed flange 58 to which the screens 50 are removably secured. A plurality of spaced upper screen support rods 59 extend between each flange 58 and an associated wall portion 46 for support of the screens 50. The walls 56 cooperate with the screens 50 to define a foreign material receiving chamber 62. The walls 56 terminate at their lower ends in vertically downwardly directed walls 64 which define an outlet 65 from the chamber 62. One wall 64*a* is of reduced length.

A deformed fabricated steel edging channel 66 conforms to and overlies each vertical wall 30 and a horizontal flange 68 extending outwardly from the upper edge thereof. A truncated triangular screen 72 extends inwardly and downwardly from each wall 30, and has a vertical portion 72*a* received between the channel 66 and the wall 30.

Each channel 66 is bolted to an associated screen portion 72*a*, thereby suspending the screens 72. A plurality of spaced lower screen support rods 73 extend between each wall 30 and the upper periphery of a grain outlet chute 74, described below. The screens 72 overlie and are supported by the rods 73.

The grain outlet chute 74 extends through and is partially supported by a housing wall 33 and comprises two parallel upstanding side walls 76 and two inclined outer and inner walls 78 and 80, respectively, extending between the walls 76. The inner wall 80 is discontinuous and defines an opening 82 below the foreign material outlet 65, and cooperates with the wall 64*a* to define an opening 84.

The walls 56 and screens 72 define a lower grain cleaning chamber 90 communicating with the upper grain cleaning chamber 52 and with the upper periphery 91 of the grain outlet chute 74. A lower foreign material receiving chamber 92 communicating with the foreign material outlet 36 is defined by the housing walls 33 and the screens 72.

Secured to and extending downwardly from the cover plate 31 are four flow control belts 94. Each belt 94 overlies the upper portion of an associated screen 50.

Rotatably secured to two spaced walls 44 of the valve box 42 is a clam shell gate 100 having an arcuate portion 102 extending between two spaced side plates 104 and positionable to cover the bottom of the valve box 42. A pulley 106 is fixed to one side plate 104.

A pan valve, generally designated 110, is rotatably secured to and extends between the spaced side walls 76 of the grain outlet chute 74 at a point generally below the foreign material chamber outlet 65. The pan valve 110 comprises a plate 112 selectively positionable to completely obstruct either of the openings 82 or 84 to selectively place the chamber 62 in communication with the outlet 36 or the chute 74, respectively. A pulley 114 is fixed to the plate 112 and is disposed between one chute wall 76 and a housing wall 31 directly below the pulley 106. A pulley 116 is fixed to a common shaft 117 with the pulley 114 and is disposed externally of the housing 15.

An endless cable 120 engages and extends between the pulleys 106 and 114, and a cable 122 engages and depends from the external pulley 116. The cable 120 extends through arcuate guide tubes 124 extending through the walls 56 and 80. The cable 120, the pulley 106 and the pulley 114 are associated with each other such that when the clam shell gate 100 is in its closed position (FIGS. 1 and 2), the pan valve 110 covers the opening 84 (FIG. 2). When the clam shell gate 100 is in its open position, the pan valve 110 covers the opening 82 (FIG. 3). The valves 100 and 110 are actuated by the external cable 122, which may be anchored at a remote location by an operator.

In operation, grain cleaning is effected with the gate 100 and the valve 110 disposed in the positions shown in FIGS. 1 and 2. Foreign material-bearing grain 130 enters the grain inlet 32 and quickly fills and overflows the closed valve box 42. The grain overflow is uniformly distributed over each screen 50 by the belts 94. Particles of foreign material, shown as the shaded areas 132, tend to be of smaller size than the grain 130 and flows through the screen 50 to the chamber 62 and the foreign material outlet 36 for disposal.

When grain reaches the lower edges of the screens 50, its direction of flow is changed by 90° by impact with the walls 30. This directional change agitates the grain, which continues to flow over the lower screens 72, thereby releasing additional foreign material 132 to the chamber 92 and the foreign material outlet 36.

Relatively clean grain flows from the lower screens 72 to the grain outlet chute 74. There is no contamination of cleaned grain with foreign material since the pan valve 110 effectively segregates the grain outlet chute 74 from the foreign material outlet 36.

The foreign material content of the discharged grain is chiefly dependent upon the foreign material content of incoming grain, although higher flow rates tend to decrease the efficiency of cleaners of a given size. For example, under optimum flow conditions, if the foreign material content of incoming grain is 20% by weight, discharged grain will have a foreign material content of about 7% by weight. A foreign material content of 5% in incoming grain will result in a discharged grain foreign material content of about 2%. If desired, excessive foreign material quantities may be removed by successive passes through a cleaner 10 or series of cleaners.

The foreign material content of grain to be shipped or stored may be sufficiently low as to require no cleaning. If so, the grain may be directed through the grain cleaner 10 without passing over the screens 50 and 72, with the gates 100 and 110 positioned as shown in FIG. 3. The gates 100 and 110 are selectively positioned by rotation of the external pulley 116 by an operator to result in rotation of the associated internal pulleys 114 and 106. With the valves 100 and 110 in the positions of FIG. 3, incoming grain freely flows through the valve box 42 and the chamber 62 to the grain outlet chute 74, without screening.

It will be apparent to those skilled in the art that it is impossible to achieve proportional bypassing of incoming grain by splitting the flow thereof through the valve box 62 and over the screens 50 by partial opening of the gate 100. Partial opening of the gate 100 results in the pan valve 110 being positioned between the positions of FIGS. 2 and 3, resulting in undesirable mixing of foreign material flowing from the chamber 62 with clean grain flowing from the lower screen 72.

Referring now to FIGS. 4–6, an improved grain cleaning apparatus 10 having proportional grain bypass capability is illustrated. (Elements of the apparatus of FIGS. 4 and 6 corresponding to those of FIGS. 1–3 are identified by corresponding reference numerals.)

The grain cleaning apparatus 10 of FIGS. 4–6 has a variably positionable gate, generally designated 150, mounted in the valve box 42. The gate 150 comprises a plate 152 supported for horizontal movement within a rectangular frame 154. The plate 152 has a pair of spaced, parallel roller chains 156 secured to its underside. The chains 156 engage a spaced pair of sprockets 160 secured to a transversely extending shaft 161 mounted for rotation on the frame 154, as by a pair of spaced ball bearings 162. A pulley 163 is fixed to one end of the shaft 161. Rotation of the pulley 163 drives the plate 152 horizontally within the frame 154.

A pulley 166 is rotatably mounted within the housing 15 directly below the pulley 163 on a shaft 167 extending through a housing wall 33. A pulley 116 is fixed to the opposite end of the shaft 167 and is rotatable by a cable 122 engaged therewith and depending therefrom. An endless cable 170 engages and extends around the pulleys 163 and 166 through a pair of upstanding cable guide tubes 172 extending through the walls 80 and 56.

Referring now to FIG. 5, the structure of the gate 150 is described in detail. The plate 152 comprises a rigid metal portion 180 having a layer 182 of polyurethane or other durable, low-friction material, secured to the upper surface thereof. The plate 152 is captured at each side by a groove 184 defined in each of a pair of frame side elements 186. A lip 187 extends perpendicularly downwardly from one end of the plate 180 and extends between the frame side elements 186.

Each frame side element 186 comprises a pair of spaced L-shaped angles 188 each having a horizontal portion 190 and an integral vertical portion 192. The vertical portions 192 of each pair of angles 188 are aligned, and the horizontal portions extend outwardly therefrom.

Aligned with and secured to the horizontal portion 192 of each lower angle 188 is a strip 194 of industrial grade polyethylene, or an equivalent durable, low-friction material, of a width equal to that of the angle portion 190. Superimposed on and secured to each strip 194 are three polyethylene spacer strips 196, 198 and 200, each of a width less than that of the strip 194. The uppermost strip 200 is slightly wider than the strips 196 and 198 and extends inwardly therefrom. The strips 196 and 198 are of a combined thickness equal to that of the plate 152. Bolts 202 secure the elements 190–200 of each frame side element 186 together.

A frame end element 206 comprises an inverted L-shaped angle 208 extending between one end of the upper vertical angle portion 192 with an upstanding L-shaped angle 210 (best seen in FIGS. 4 and 6) secured thereto and depending therefrom. The angle 210 faces longitudinally inwardly to provide a stop for the plate 152.

A second frame end element 212 comprises an end plate 214 bolted to an L-shaped angle 216 secured to and extending between the side elements 186. A horizontal portion 190 of the angle 216 is aligned with the corresponding horizontal portion 190 of the anlges 188. A gate stop bar 218 of less width than the angle portion 190 is spaced downwardly thereof on the end plate 214 to provide a stop for the lip 181.

Referring again to FIGS. 4 and 6, a bypass chute 220 extends downwardly from the frame 154 to a wall 56 and cooperates therewith to define an opening 224 to place the gate 150 in communication with the chamber 90 and the grain outlet chute 74.

The upper foreign material chamber 62 terminates in a downwardly extending conduit 226 communicating with the lower foreign material chamber 92 and the foreign material outlet 36.

FIG. 4 illustrates the grain cleaning apparatus 10 with the gate 150 in its fully open position. Entering grain 130 is directed through the gate 150 and the chute 220 to the outlet chute 74 without cleaning. Passage of the grain through the chute 220 eliminates undesirable contamination with foreign material in the chamber 62.

Referring now to FIG. 6, the gate 150 is shown in a partially open position whereby a preselected proportion of incoming grain flow 130 bypasses the cleaning screens 50 and 72. With the valve box outlet constricted as in FIG. 6 grain fills the box 42 and overflows to the screens 50 and 72. Grain flowing from the lower screen 72 merges with the flow of grain from the bypass chute 220 and is discharged therewith. Foreign material 132 flowing through the screens 50 and 72 flows from the upper foreign material chamber 62 through the conduit 226 to the lower foreign material chamber 92 and the foreign material outlet 36.

It is apparent that the plate 152 is selectively positionable within the valve box 42 to provide an outlet of infinitely variable size, between fully open and fully closed portions of the plate 152, thereby effecting a preselected proportional bypass of the screens 50 and 72.

With knowledge of the foreign material content of incoming grain 130, an operator may selectively position the gate 152 to bypass a selected proportion of incoming grain, thereby controlling the foreign material content of the grain leaving the discharge chute 74.

The construction of FIGS. 4–6 is relatively economical since there are fewer moving parts than in the apparatus of FIGS. 1–3. The upper surface coating 182 of the plate 152 prevents erosion of the plate 152 by grain flow, and smooth travel of the gate 152 is assured by the polyethylene strips 190, 196–198 and 200 lining the frame 154.

The foregoing detailed description is given for clearness of understanding only and no unnecessary limitations should be understood therefrom, as modifications will be obvious to those skilled in the art.

We claim:

1. In a grain cleaning apparatus for removing fine foreign material from grain, said apparatus being of the type having an upright housing, at least one layer of inclined screens within said housing, said screens supporting grain for gravity flow while foreign material passes therethrough, at least one wall disposed below said screen layer, said wall cooperating with said screen layer to define a foreign material receiving chamber, a grain inlet disposed above and communicating with said screen layer to deliver grain for gravity flow over said screens in a relatively thin layer, a grain outlet disposed below and communicating with said screen layer, and a foreign material outlet communicating with said foreign material receiving chamber, said grain outlet being distinct and separate from said foreign material outlet, and means for selectively directing all of said grain over said screens or permitting all of said grain to bypass said screens, the improvement which comprises:

means for directing only a selected proportion of grain flowing through said grain inlet to said screen layer and simultaneously directing the remainder of said grain flowing through said grain inlet to said grain outlet without said grain passing over said screens; and a grain segregating conduit for carrying said remainder of said grain through said foreign material receiving chamber directly into said grain outlet.

2. The improvement of claim 1 wherein said grain directing means comprises a gate disposed below said grain inlet, and means for selectively positioning said gate anyplace between a fully open position and a fully closed position.

3. The improvement of claim 2 which includes a grain-receiving box mounted below said grain inlet and having an inlet and an outlet, said box inlet being disposed directly below said grain inlet at an elevated level of said screen layer and communicating therewith, and said gate being mounted in said box outlet to obstruct the latter to any selected extent, whereby grain flowing from said grain inlet fills said box and part of said grain overflows onto said screen layer when said box is sufficiently obstructed that grain flows into said box more rapidly than it can flow out through the box outlet.

4. The improvement of claim 3 wherein said conduit communicates with said box outlet and extends downwardly therefrom.

5. The improvement of claim 3 wherein said gate comprises a plate mounted in said box outlet for transverse sliding movement, and said selective positioning means operatively engages said plate.

6. In a grain cleaning apparatus for removing fine foreign material from grain, said apparatus being of the type having an upright housing with downwardly and outwardly inclined upper walls and downwardly and inwardly inclined lower walls, an upper inclined screen layer mounted within said housing facing said upper walls, a lower inclined screen layer mounted within said housing facing said lower walls, said upper screen layer overlying and communicating with said lower screen layer, both said screen layers supporting grain for gravity flow while foreign material passes therethrough, a plurality of interior walls disposed within said housing between said upper and lower screen layers, said interior walls cooperating with said upper screen layer to define a first foreign material receiving chamber, and said lower screen layer cooperating with said inclined lower housing walls to define a second foreign material receiving chamber, a grain inlet in said housing disposed above and communicating with said upper screen layer, a grain outlet in said housing communicating with said lower screen layer, and a foreign material outlet communicating with said first and second foreign material receiving chambers, the improvement which comprises:

a frame having an opening and mounted within said housing a short distance below the upper end of said upper screen layer and in communication with said grain inlet;

a gate mounted in said frame for horizontal sliding movement between a fully open position and a fully closed position;

means engaging said gate for selectively positioning it in any position from fully open to fully closed so as to selectively partially obstruct said frame opening to allow a selected proportion of grain flowing through said grain inlet to flow proportion of grain flowing through said grain inlet to flow through said frame whereby said selected proportion of grain bypasses said upper screen layer;

and a conduit communicating with said frame opening and extending through said first foreign material receiving chamber to one of said internal walls, said one of said internal walls and said conduit cooperating to define an opening in said wall in communication with said grain outlet and segregated from said foreign material outlet, whereby said grain diverted away from said upper screen layer is directed to said grain outlet without passing over either of said screen layers.

7. The improvement of claim 6 which includes a grain-receiving box mounted below said grain inlet and having an inlet and an outlet, said box inlet being disposed directly below said grain inlet at an elevated level of said upper screen layer and communicating therewith, and said frame defining a box outlet, whereby grain flowing from said grain inlet fills said box and part of said grain overflows onto said upper screen layer when said frame is sufficiently obstructed that grain flows into said box more rapidly than it can flow out through the box outlet.

* * * * *